US011173532B2

(12) United States Patent
Liao

(10) Patent No.: US 11,173,532 B2
(45) Date of Patent: Nov. 16, 2021

(54) TUBE BENDER

(71) Applicant: LIH YANN INDUSTRIAL CO., LTD., Taichung (TW)

(72) Inventor: Po-Lin Liao, Taichung (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 77 days.

(21) Appl. No.: 16/721,417

(22) Filed: Dec. 19, 2019

(65) Prior Publication Data

US 2021/0187575 A1 Jun. 24, 2021

(51) Int. Cl.
*B21D 9/12* (2006.01)
*B21D 7/022* (2006.01)

(52) U.S. Cl.
CPC ..... *B21D 9/12* (2013.01); *B21D 7/022* (2013.01)

(58) Field of Classification Search
CPC . B21D 7/00; B21D 7/02; B21D 7/021; B21D 7/022; B21D 7/024; B21D 9/12; B21D 9/05; B21D 9/055
See application file for complete search history.

(56) References Cited

U.S. PATENT DOCUMENTS 664,943 A * 1/1901 Goldenberg ..... B21D 7/022 72/217
828,338 A * 8/1906 Reynolds ..... B21D 7/022 72/217
3,172,452 A * 3/1965 Bryant ..... B21D 7/021 72/388
3,342,057 A * 9/1967 Stone ..... B25B 1/2452 72/333
4,249,407 A * 2/1981 Fogleman ..... B21D 7/022 72/159
4,522,055 A * 6/1985 Berger ..... B21D 7/02 72/477
7,234,338 B2 * 6/2007 Mirtz ..... B21D 7/021 72/459
2010/0180653 A1 * 7/2010 Wolf ..... B21F 1/00 72/156

* cited by examiner

*Primary Examiner* — Edward T Tolan
(74) *Attorney, Agent, or Firm* — Muncy, Geissler, Olds & Lowe, P.C.

(57) ABSTRACT

A tube bender is provided, including: a fixation portion, configured to be held by a fixation base; a plurality of bending portions, connected with the fixation portion, each of the plurality of bending portions has a circumferential guiding face, at least two of curvature of radiuses of the circumferential guiding faces of the plurality of bending portions are different.

2 Claims, 5 Drawing Sheets

TUBE BENDER

BACKGROUND OF THE INVENTION

Field of the Invention

The present invention relates to a tube bender.

Description of the Prior Art

According to various requirements, a tube, such as brake copper tube, cold liquid circuit copper tube or the like, is bent into a configuration having one single or a plurality of different curvature of radiuses, for good installation to a device or mechanism.

A conventional tube bender is generally provided with one single arched portion so that it can provide only one bending curvature of radius for the tube. To bend a tube into a configuration having different curvature of radiuses, it requires a plurality of tube benders including respective arched portions having different curvature of radiuses. As a result, it is inconvenient, time-consuming costly for bend the tube due to the complicated bending process and the requirement of needing a plurality of tube benders.

The present invention is, therefore, arisen to obviate or at least mitigate the above-mentioned disadvantages.

SUMMARY OF THE INVENTION

The main object of the present invention is to provide a tube bender for bending tubes into bent configurations with different curvature of radiuses.

To achieve the above and other objects, the present invention provides a tube bender, including: a fixation portion, configured to be held by a fixation base; a plurality of bending portions, connected with the fixation portion, each of the plurality of bending portions has a circumferential guiding face, at least two of curvature of radiuses of the circumferential guiding faces of the plurality of bending portions are different.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 2:
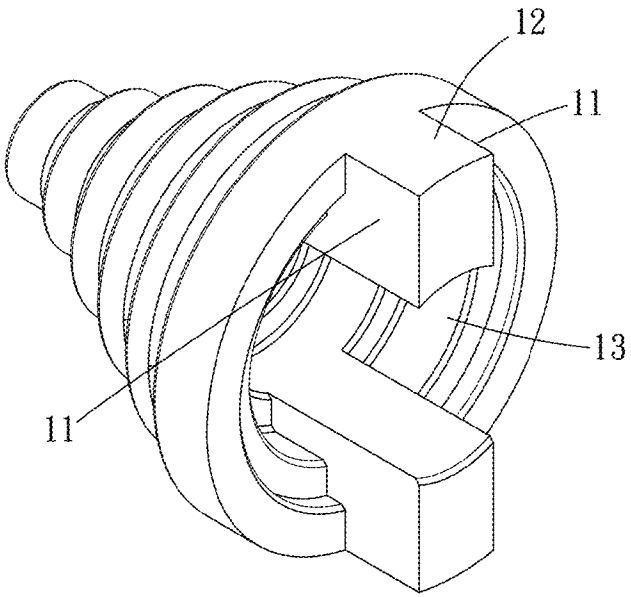
FIG. 2 is another stereogram of a preferable embodiment of the present invention.
Figure 1:
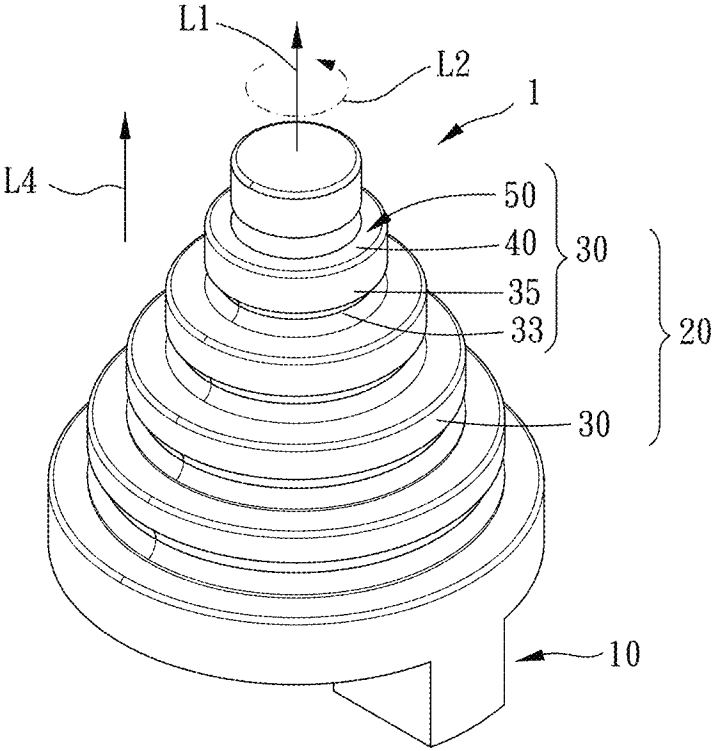
FIG. 1 is a stereogram of a preferable embodiment of the present invention.
Figure 3:
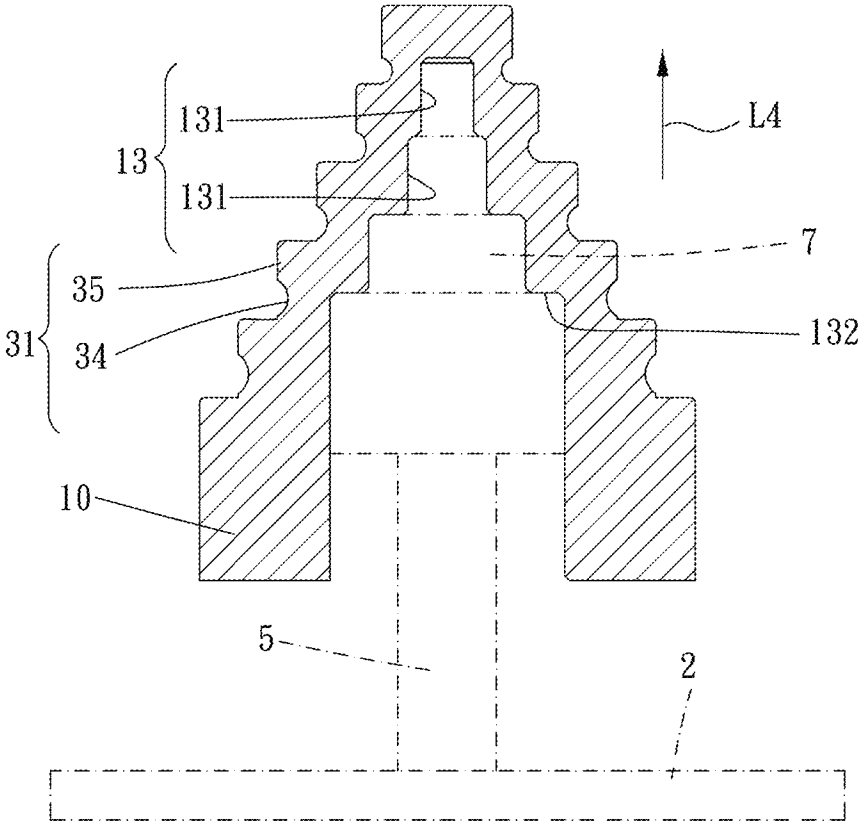
FIG. 3 is a cross-sectional view of a preferable embodiment of the present invention.
Figure 4:
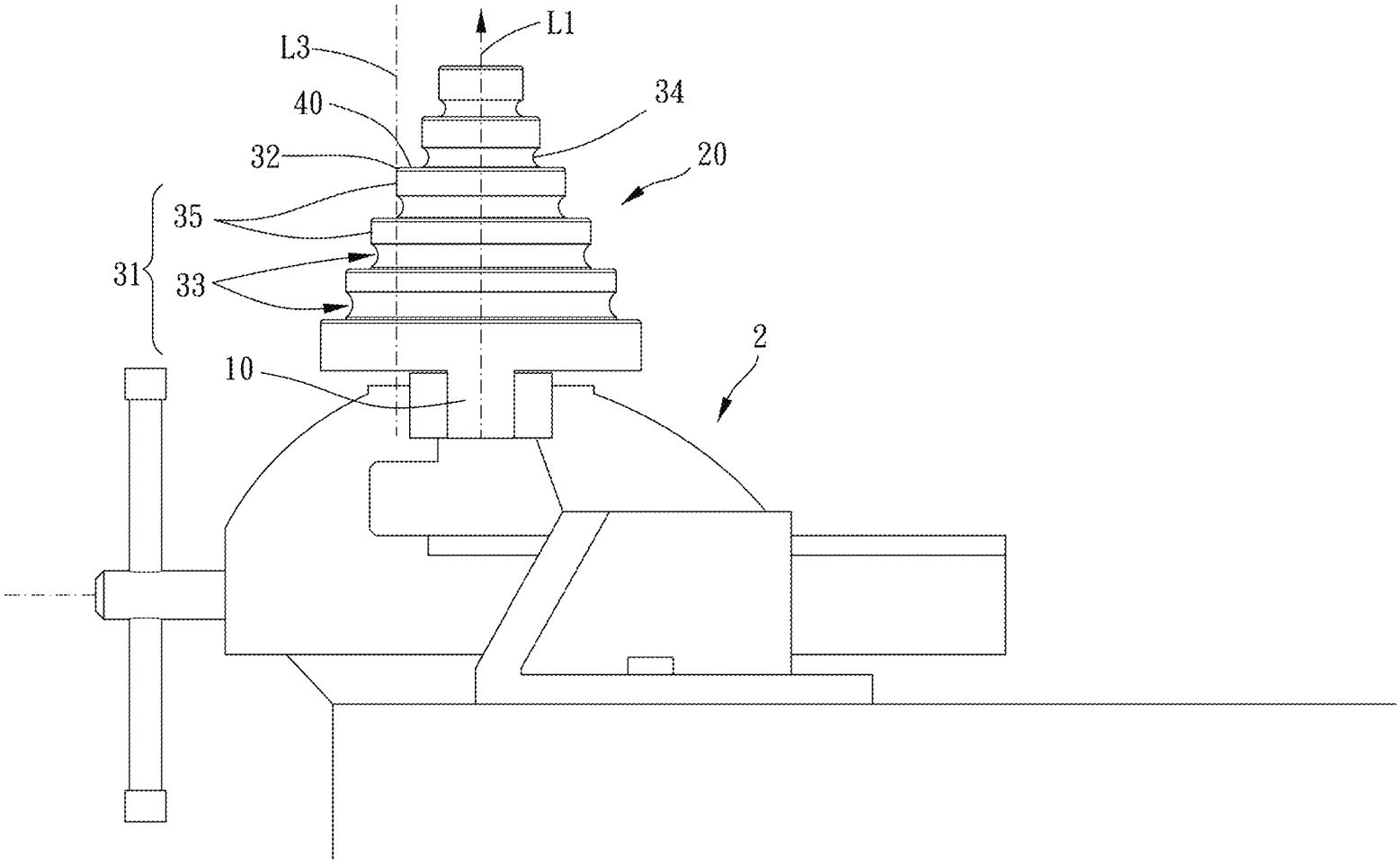
FIG. 4 is a drawing showing a tube bender held by a fixation base according to a preferable embodiment of the present invention.
Figure 5:
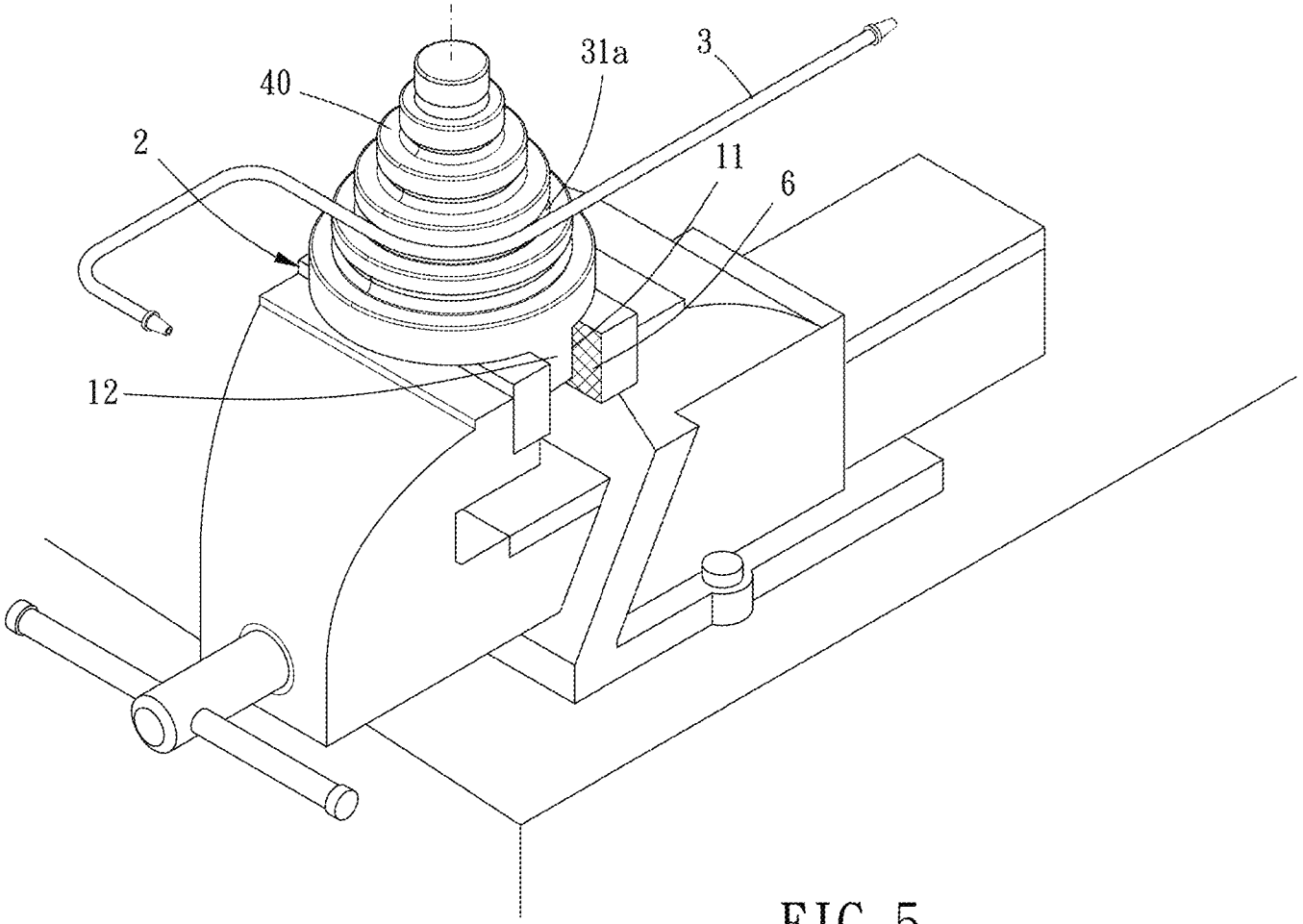
FIGS. 5 and 6 are drawings showing bending of a tube according to a preferable embodiment of the present invention.
Figure 6:
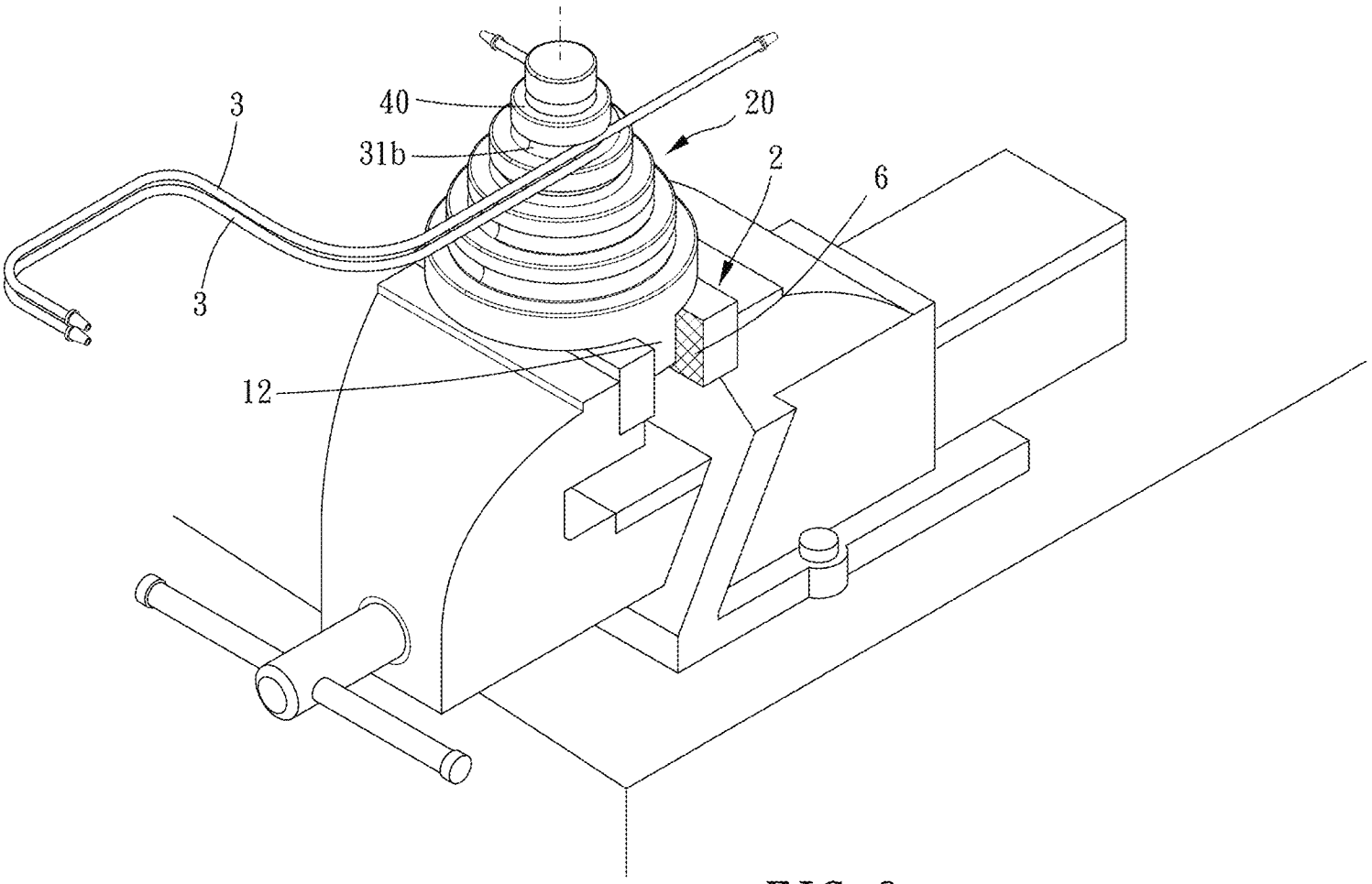

Please refer to FIGS. 1 to 6 for a preferable embodiment of the present invention. A tube bender 1 of the present invention includes a fixation portion 10, a bending structure 20 and a plurality of bending portions 30.

The fixation portion 10 is configured to be held by a fixation base 2 (such as a vice); the plurality of bending portions 30 is connected with the fixation portion 10 and defines an axial direction L1 and a circumferential direction L2 around the axial direction L1, each of the plurality of the plurality of bending portions 30 has a circumferential guiding face 31, at least two of curvature of radiuses of the circumferential guiding faces 31 of the plurality of bending portions 30 are different. Whereby, the tube bender 1 can be used for bending tubes into bent configurations with different curvature of radiuses.

In this embodiment, each of the plurality of bending portions 30 is pillar-shaped (cylindrical). A tube 3 is engaged within one of the plurality of bending portions 30 and bent along the circumferential guiding face 31 to have a required curvature of radius.

Each of the plurality of bending portions 30 further includes a circumferential curved chamfer 32, for avoiding damage to the tube 3.

The bending structure 20 is connected with the fixation portion 10, the bending structure 20 includes the plurality of bending portions 30 and at least one abutting face 40 which faces axially, and at least adjacent two of the plurality of bending portions 30 are axially arranged and connected with each other and arranged with a shoulder 50 disposed therebetween. In this embodiment, the plurality of bending portions 30 and the fixation portion 10 are integrally formed of one piece in a tapered fashion, and at least one said shoulder 50 includes at least one said abutting face 40 facing in the axial direction L1. In this embodiment, the bending structure 20 includes a plurality of said abutting faces 40. During bending of the tube 3, the abutting face 40 is configured to stably and smoothly bend the tube 3.

At least one said circumferential guiding face 31 includes an annular concave face 33 which is radially concave and extends along the circumferential direction L2, the annular concave face 33 is preferably an arced face 34, thus be capable of stably and smoothly bending the tube 3. In this embodiment, each said circumferential guiding face 31 includes one said annular concave face 33, and each said annular concave face 33 has a curvature of radius different from one another in the circumferential direction L2, for bending tubes to have various curvature of radiuses.

At least one said circumferential guiding face 31 further includes an annular plane 35 adjacent to one said annular concave face 33 and extending circumferentially. In this embodiment, each said circumferential guiding face 31 includes one said annular plane 35 so that a plurality of tubes can also be bent about the annular planes 35.

An extending line L3 which extends in a direction parallel to the axial direction L1 and on which the annular plane 35 is located (FIG. 4), wherein the abutting face 40 is not radially beyond the extending line L3.

The fixation portion 10 and the plurality of bending portions 30 are arranged along a first direction L4. Preferably, each said annular concave face has a curvature of radius different from one another in the circumferential direction L2 thereof and has a span different from one another in the first direction L4.

The fixation portion 10 includes two fixation planes 11 at two opposite sides thereof, extending in the first direction L4 and configured to be held by the fixation base 2. In this embodiment, the fixation portion 10 includes two legs 12 arranged separately and configured to be held by the fixation base 2. Two clamping faces 6 of the fixation base 2 clamp the two opposite sides of respective one of the two legs 12, thus stably clamping the fixation portion 10.

The fixation portion 10 further includes an inner indentation 13 around which at least one said bending portion 30 is disposed and which is open at a side of the tube bender, thus being material-saving, light-weight, and capable of receiving insertion connection of a supporting rod 5 into the inner indentation 13. Preferably, the inner indentation 13 is a stepped hole which includes a plurality of hole sections 131 whose diametric dimensions are different and which is tapered in the first direction L4 away from the fixation portion 10 so that an insertion portion 7 of the supporting rod 5 can match with the stepped hole for stable connection. between adjacent two of the plurality of hole sections 131 is a contact face 132 which faces in a direction toward the fixation portion 10 and configured for stable abutment of the insertion portion 7. In this embodiment, the inner indentation 13 is disposed between the two legs 12.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tube bender, including:

a fixation portion, configured to be held by a fixation base;

a plurality of bending portions, connected with the fixation portion, each of the plurality of bending portions has a circumferential guiding face, at least two of curvature of radiuses of the circumferential guiding faces of the plurality of bending portions are different, wherein the fixation portion includes two legs arranged separately and configured to be held by the fixation base, wherein the fixation portion further includes an inner indentation around which at least one said bending portion is disposed and which is open at a side of the tube bender, wherein the inner indentation is a stepped hole which includes a plurality of hole sections whose diametric dimensions are different, and wherein the tube bender further includes a bending structure, the bending structure is connected with the fixation portion, the bending structure includes the plurality of bending portions and at least one abutting face which faces axially, at least adjacent two of the plurality of bending portions are axially arranged and connected with each other and arranged with a shoulder disposed therebetween, and at least one said shoulder includes one said abutting face; each of the plurality of bending portions is cylindrical; each of the plurality of bending portions further includes a circumferential curved chamfer connected with one said abutting face; the fixation portion and the plurality of bending portions are arranged along a first direction, each of the two legs includes two fixation planes disposed at two opposite sides thereof and extending in the first direction; the stepped hole is tapered in the first direction away from the fixation portion; between two adjacent of the plurality of hole sections is a contact face which faces in an opposite direction compared to the first direction; the inner indentation is disposed between the two legs; each said circumferential guiding face includes an annular concave face and an annular plane adjacent to the annular concave face and extending circumferentially; each said annular concave face has a curvature of radius different from one another in a circumferential direction thereof and has a span different from one another in the first direction.

2. The tube bender of claim 1, wherein the annular concave face is an arced face.

* * * * *